US012303734B2

(12) United States Patent
Wang

(10) Patent No.: US 12,303,734 B2
(45) Date of Patent: May 20, 2025

(54) ADJUSTABLE DUMBBELL

(71) Applicant: QINGDAO KINGDOM HEALTH INDUSTRY CO., LTD., Shandong (CN)

(72) Inventor: Zhixiong Wang, Shandong (CN)

(73) Assignee: QINGDAO KINGDOM HEALTH INDUSTRY CO., LTD., Shandong (CN)

( * ) Notice: Subject to any disclaimer, the term of this patent is extended or adjusted under 35 U.S.C. 154(b) by 0 days.

(21) Appl. No.: 17/917,247

(22) PCT Filed: Jan. 5, 2022

(86) PCT No.: PCT/CN2022/070220
§ 371 (c)(1),
(2) Date: Oct. 6, 2022

(87) PCT Pub. No.: WO2023/040133
PCT Pub. Date: Mar. 23, 2023

(65) Prior Publication Data

US 2024/0198166 A1 Jun. 20, 2024

(30) Foreign Application Priority Data

Sep. 18, 2021 (CN) ..... 202122270164.4
Dec. 29, 2021 (CN) ..... 202111642316.7

(51) Int. Cl.
*A63B 21/072* (2006.01)
*A63B 21/075* (2006.01)

(52) U.S. Cl.
CPC ..... *A63B 21/075* (2013.01); *A63B 21/0726* (2013.01)

(58) Field of Classification Search
None
See application file for complete search history.

(56) References Cited

U.S. PATENT DOCUMENTS 11,167,167 B1 * 11/2021 Weng ..... A63B 21/0726
2016/0166873 A1 * 6/2016 Liu ..... A63B 21/0726 482/107

(Continued)

FOREIGN PATENT DOCUMENTS

CN 102258845 11/2011
CN 109621294 4/2019

(Continued)

OTHER PUBLICATIONS

"International Search Report (Form PCT/ISA/210) of PCT/CN2022/070220," mailed on May 27, 2022, pp. 1-5.

(Continued)

*Primary Examiner* — Shila Jalalzadeh Abyaneh
(74) *Attorney, Agent, or Firm* — JCIPRNET

(57) ABSTRACT

An adjustable dumbbell includes a dumbbell bar, linear adjusting mechanisms and counterweight mechanisms disposed at both ends of the dumbbell bar. The dumbbell bar includes a sleeve and two telescopic mandrels disposed in the sleeve and in sliding fit with each other, the counterweight mechanisms are coaxially disposed at both ends of the dumbbell bar, and configured to provide the overall weight of the adjustable dumbbell. Each linear adjusting mechanism includes a limiting assembly and a gear adjusting assembly. The gear adjusting assembly is configured to allow the two telescopic mandrels to be close to or away from each other, so as to control the overall combination length of the two telescopic mandrels. The limiting assembly is configured to limit the gear adjusting assembly.

7 Claims, 9 Drawing Sheets

(56) References Cited

U.S. PATENT DOCUMENTS

| | | | | |
|---|---|---|---|---|
| 2017/0001061 | A1* | 1/2017 | Marjama | A63B 71/0036 |
| 2022/0096890 | A1* | 3/2022 | Lu | A63B 21/0728 |
| 2022/0193479 | A1* | 6/2022 | Wu | A63B 21/075 |
| 2022/0193480 | A1* | 6/2022 | Wu | A63B 21/075 |
| 2022/0193482 | A1* | 6/2022 | Wu | A63B 21/0726 |
| 2023/0001258 | A1* | 1/2023 | Svenberg | A63B 21/075 |
| 2023/0052772 | A1* | 2/2023 | Wang | A63B 21/075 |

FOREIGN PATENT DOCUMENTS

| | | | | | |
|---|---|---|---|---|---|
| CN | 109621294 | A | * | 4/2019 | A63B 21/0726 |
| CN | 111450475 | | | 7/2020 | |
| CN | 111450475 | A | * | 7/2020 | A63B 21/075 |
| CN | 212282678 | U | * | 1/2021 | A63B 21/075 |
| CN | 212789573 | | | 3/2021 | |
| CN | 112587858 | | * | 4/2021 | |
| CN | 112587858 | A | * | 4/2021 | A63B 21/0726 |
| CN | 112717327 | A | * | 4/2021 | A63B 21/0726 |
| CN | 113144514 | | | 7/2021 | |

OTHER PUBLICATIONS

"Written Opinion of the International Searching Authority (Form PCT/ISA/237) of PCT/CN2022/070220," mailed on May 27, 2022, pp. 1-4.

* cited by examiner

ADJUSTABLE DUMBBELL

CROSS-REFERENCE TO RELATED APPLICATION

This application is a 371 of international application of PCT application serial no. PCT/CN2022/070220 filed on Jan. 5, 2022 which claims the priority benefit of China application no. 202122270164.4 filed on Sep. 18, 2021 and China application no. 202111642316.7 filed on Dec. 9, 2021. The entirety of each of the above mentioned patent applications is hereby incorporated by reference herein and made a part of this specification.

TECHNICAL FIELD

The present application relates to the technical field of health and fitness facilities, in particular to an adjustable dumbbell.

DESCRIPTION OF RELATED ART

In the prior art, there are two kinds of dumbbells, one is a dumbbell bar and weight plates integrated all-in-one apparatus of which the weight is unadjustable, as the user's demands for strength gradually increases, it is necessary to purchase multiple sets of dumbbells of different weights, which causes a high cost and a large occupied space; and in the other one, a dumbbell bar and weight plates are detachably connected by bolts, the two ends of a holding rod are equipped with a corresponding number of weight plates according to actual demands, and the length of the dumbbell bar needs to be adjusted, which causes troublesome operation.

Therefore, further researches are required in the prior art.

SUMMARY

In view of the shortcomings in the prior art, the present application provides an adjustable dumbbell, which solves the problem of troublesome counterweight adjustment of dumbbells set forth in the above background, and may achieve rapid adjustment of dumbbell bars.

For achieving the above objectives, the present application provides the following technical solution. An adjustable dumbbell is provided and includes a dumbbell bar, linear adjusting mechanisms and counterweight mechanisms. The linear adjusting mechanisms and the counterweight mechanisms are disposed at both ends of the dumbbell bar, and said dumbbell bar includes a sleeve, and two telescopic mandrels disposed in the sleeve and in sliding fit with each other.

The counterweight mechanisms are coaxially disposed at both ends of the dumbbell bar, and configured to provide an overall weight of the adjustable dumbbell.

Each of said linear adjusting mechanisms includes a limiting assembly and a gear adjusting assembly.

The gear adjusting assembly is configured to allow the two telescopic mandrels to be close to or away from each other, so as to control an overall combination length of the two telescopic mandrels; and the limiting assembly is configured to limit the gear adjusting assembly.

Said limiting assembly includes a U-shaped fixed block and a locking pin, one end of the locking pin is a locking pin fixed block, and the other end of the locking pin passes through the U-shaped fixed block to limit the gear adjusting assembly that is adjusted; and a reset spring is disposed between said locking pin fixed block and the U-shaped fixed block, and is configured to reset the locking pin.

A connector is disposed between said telescopic mandrels, and is configured to connect the two telescopic mandrels; one side of each of said two telescopic mandrels is provided with a linear groove, said two linear grooves of the telescopic mandrels define a mounting space of the connector, and an outside of each of said telescopic mandrels is provided with an external thread extending along an axial direction of the telescopic mandrel.

An end portion of each of said two telescopic mandrels is sleeved with a circular guide plate, and a guide bulge corresponding to the linear groove is disposed on said guide plate.

Said gear adjusting assembly includes an inner fluted disc and a planetary gear structure; said planetary gear structure comprises two planetary gear carriers, a planetary gear and an internal helical gear, and the planetary gear and the internal helical gear are disposed between the two planetary gear carriers; wherein said internal helical gear is sleeved on the outside of the telescopic mandrel and disposed in centers of the planetary gear carriers, and the internal helical gear is in threaded connection with the telescopic mandrel and drives the telescopic mandrel to carry out a linear reciprocating motion; and said planetary gear is disposed on the planetary gear carriers, an inner side of the planetary gear is meshed with the internal helical gear, and an outer side of the planetary gear is meshed with the inner fluted disc.

A locking assembly is disposed between said internal helical gear and one of said planetary gear carriers towards the telescopic mandrel, said locking assembly includes a locking clamp plate and a clamp plate mounting sleeve, said clamp plate mounting sleeve is sleeved on the sleeve, and is in threaded connection with an end portion of said sleeve; one side of said clamp plate mounting sleeve is provided with a clamp plate mounting groove, and the other side of said clamp plate mounting sleeve is connected to the internal helical gear in a sleeve-connected mode; and one end of said locking clamp plate is disposed in the clamp plate mounting groove, and the other end of said locking clamp plate passes through the sleeve to clamp the connector.

An outside of said sleeve is further sleeved with a driving cylinder, and said inner fluted disc is connected to the driving cylinder in a clamped mode, wherein a center of the inner fluted disc is provided with a plurality of bulges, two ends of the driving cylinder are provided with clamp slots corresponding to the bulges, and the driving cylinder rotates to drive a rotation of the inner fluted disc.

Each of said counterweight mechanism includes a plurality of counterweight substrates, an upper end and a lower end of each of said counterweight substrates are each provided with a mounting groove, the counterweight substrates are connected through a buckling assembly, and the buckling assembly is detachably connected to said mounting grooves of the counterweight substrates.

The adjustable dumbbell further includes a dumbbell holder configured to secure said adjustable dumbbell.

Compared with the prior art, the adjustable dumbbell provided by the present application has the following beneficial effects.

1. The adjustable dumbbell provided by the present application includes the telescopic dumbbell bar, the linear adjusting mechanisms, an substrate assembly and the limiting assembly, the length of the telescopic dumbbell bar is adjusted via the adjusting assembly, and then secured via the limiting assembly after adjustment is completed, so as to achieve the length adjustment of the dumbbell bar, and then, the substrate counterweights at the two ends of the dumbbell bar are further adjusted, therefore, the adjustable dumbbell is convenient to adjust, and solves the problem of inconvenient adjustment.

2. In the present application, the telescopic dumbbell bar includes the sleeve, the mandrels, the connector, the inner fluted disc secured on the sleeve, and a gear set, in the process of adjustment, the rotation of the driving cylinder further rotates the inner fluted disc, the inner fluted disc drives the gear set to act, then the gear set drives the two ends of the telescopic mandrels to rotate, and through the distance adjustment between the telescopic mandrels, the length adjustment of the telescopic dumbbell bar is achieved.
3. The limiting assembly of the present application includes the U-shaped fixed block and the locking pin, in the process of adjustment, after rotation and adjustment are implemented, an effect of limiting is achieved by rotating the locking pin to clamp the gear.

DESCRIPTION OF THE EMBODIMENTS

The following clearly and completely describes the technical solutions in the examples of the present application with reference to the accompanying drawings in the examples of the present application. Apparently, the described examples are merely a part rather than all of the examples of the present application. All other examples obtained by a person of ordinary skill in the art based on the examples of the present application without creative efforts shall fall within the protection scope of the present application.

Example 1

Figure 1:
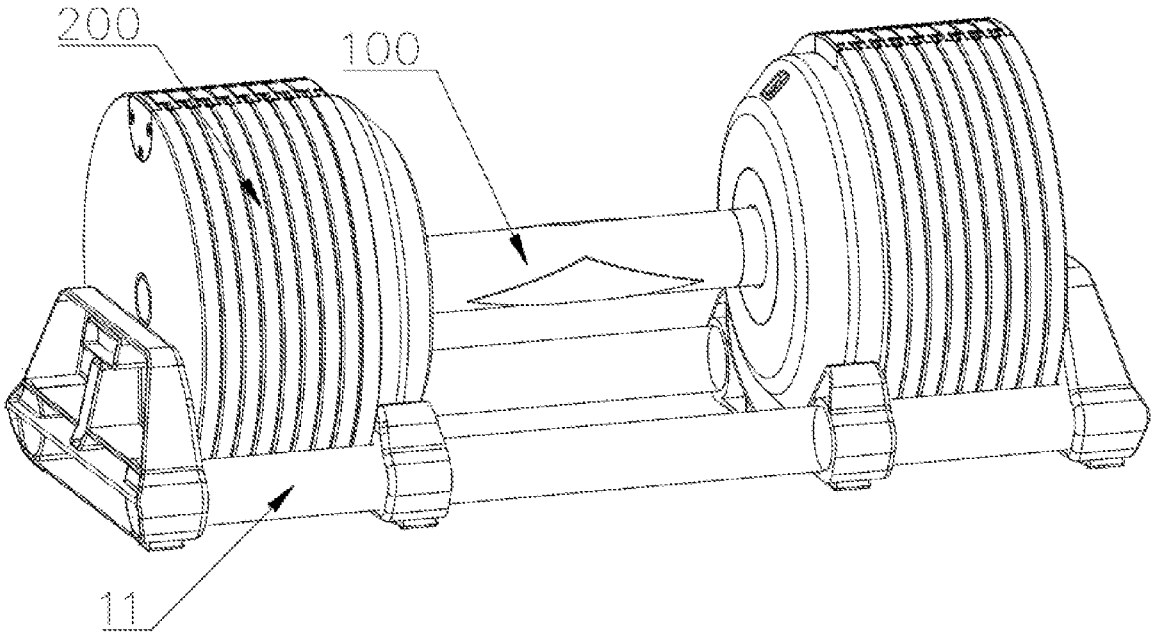
FIG. 1 is a schematic diagram of an overall structure of the adjustable dumbbell according to the present application.
Figure 2:
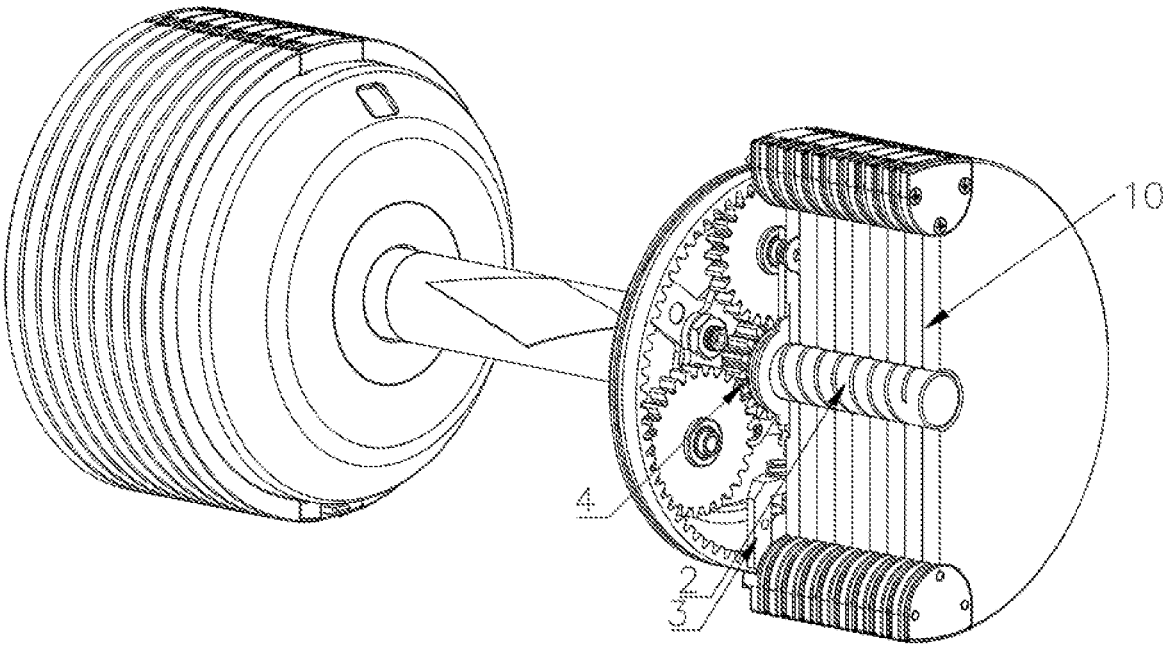
FIG. 2 is a schematic diagram of a partial section structure of the adjustable dumbbell according to the present application.
Figure 3:
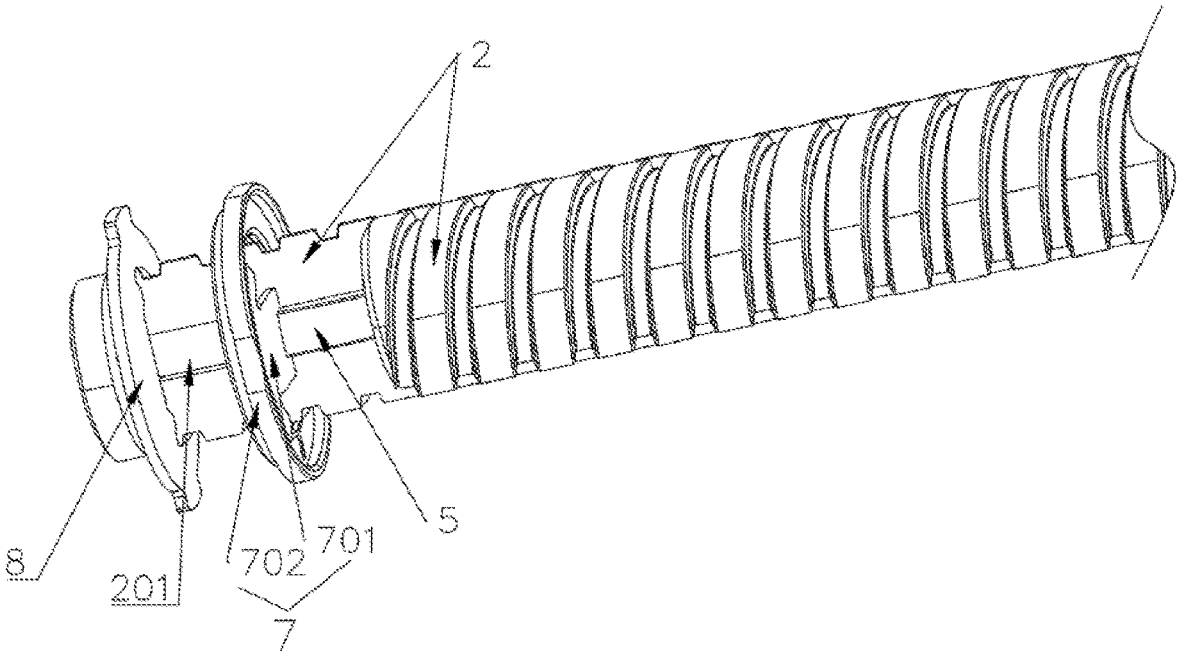
FIG. 3 is a schematic diagram of a mounting structure of two telescopic mandrels.
Figure 4:
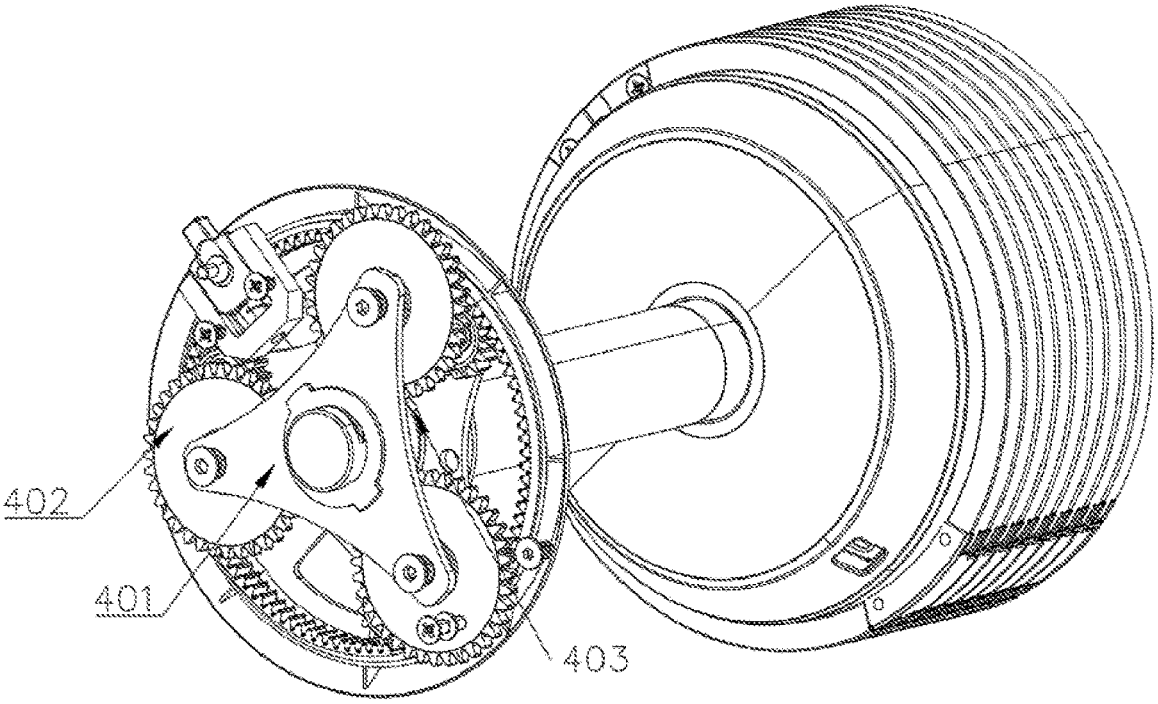
FIG. 4 is a schematic diagram I of a local structure of the adjustable dumbbell according to the present application.
Figure 5:
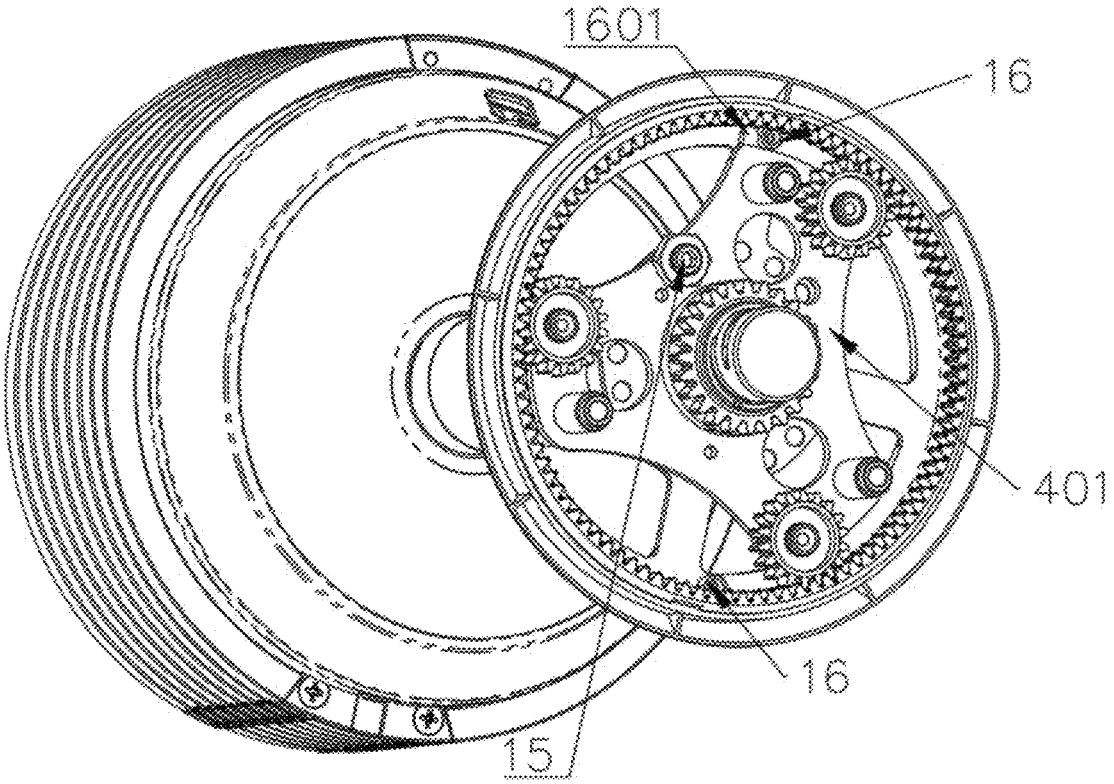
FIG. 5 is a schematic diagram II of a local structure of the adjustable dumbbell according to the present application.
Figure 6:
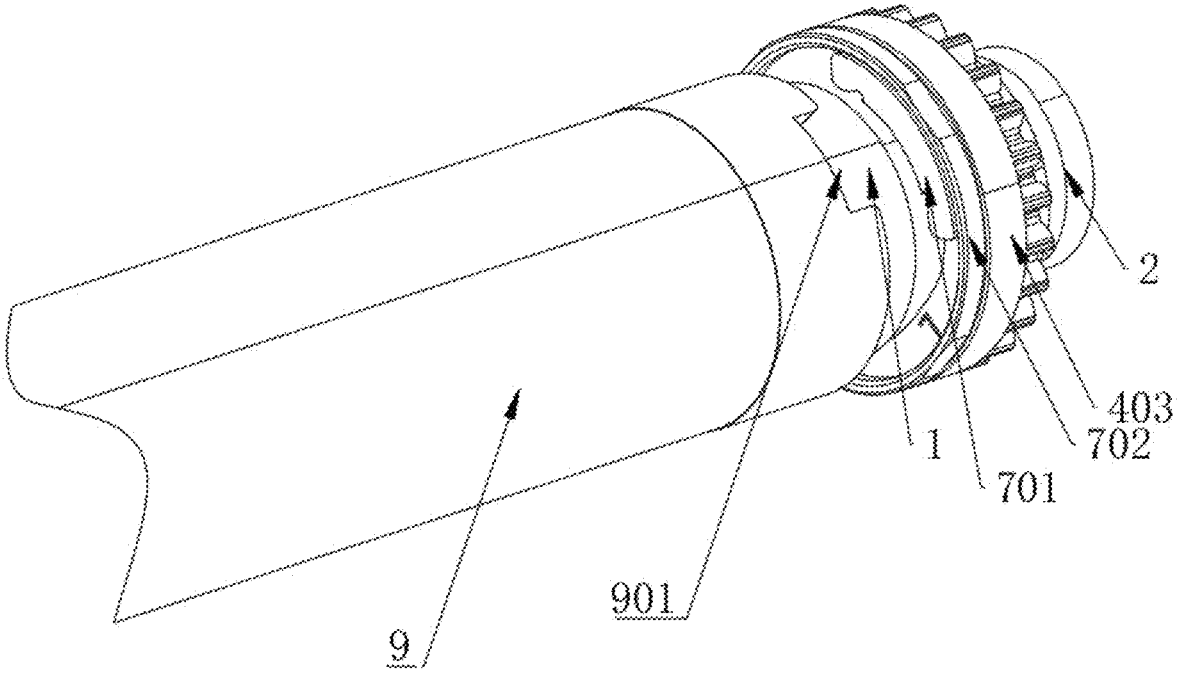
FIG. 6 is a mounting schematic diagram of an internal helical gear and a dumbbell bar.
Figure 7:
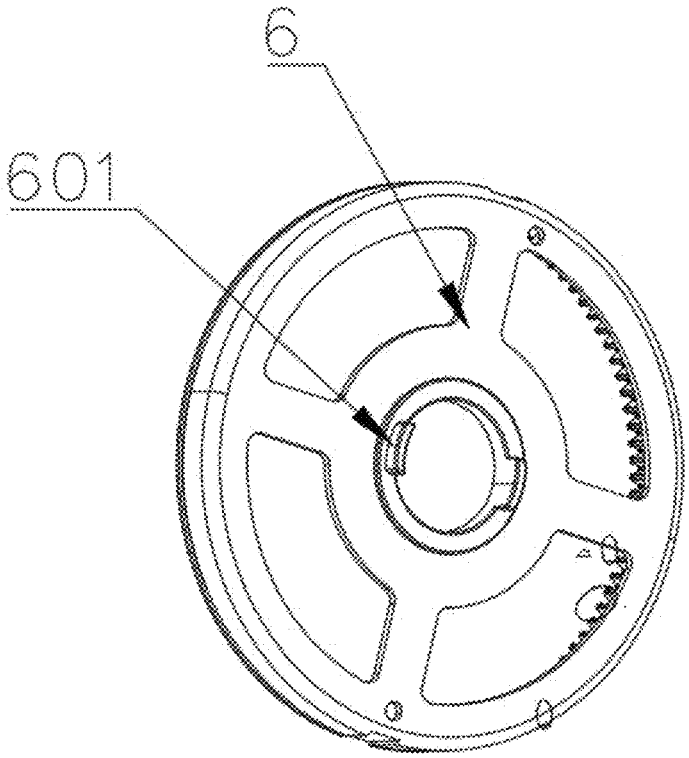
FIG. 7 is a structural schematic diagram of an inner fluted disc.
Figure 8:
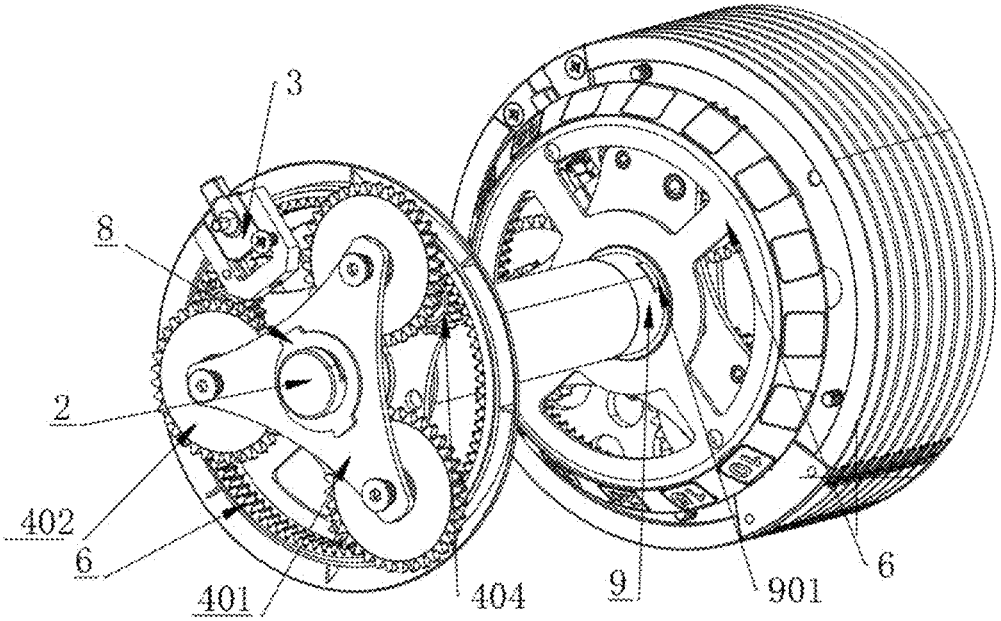
FIG. 8 is a schematic diagram III of a local structure of the adjustable dumbbell according to the present application.
Figure 9:
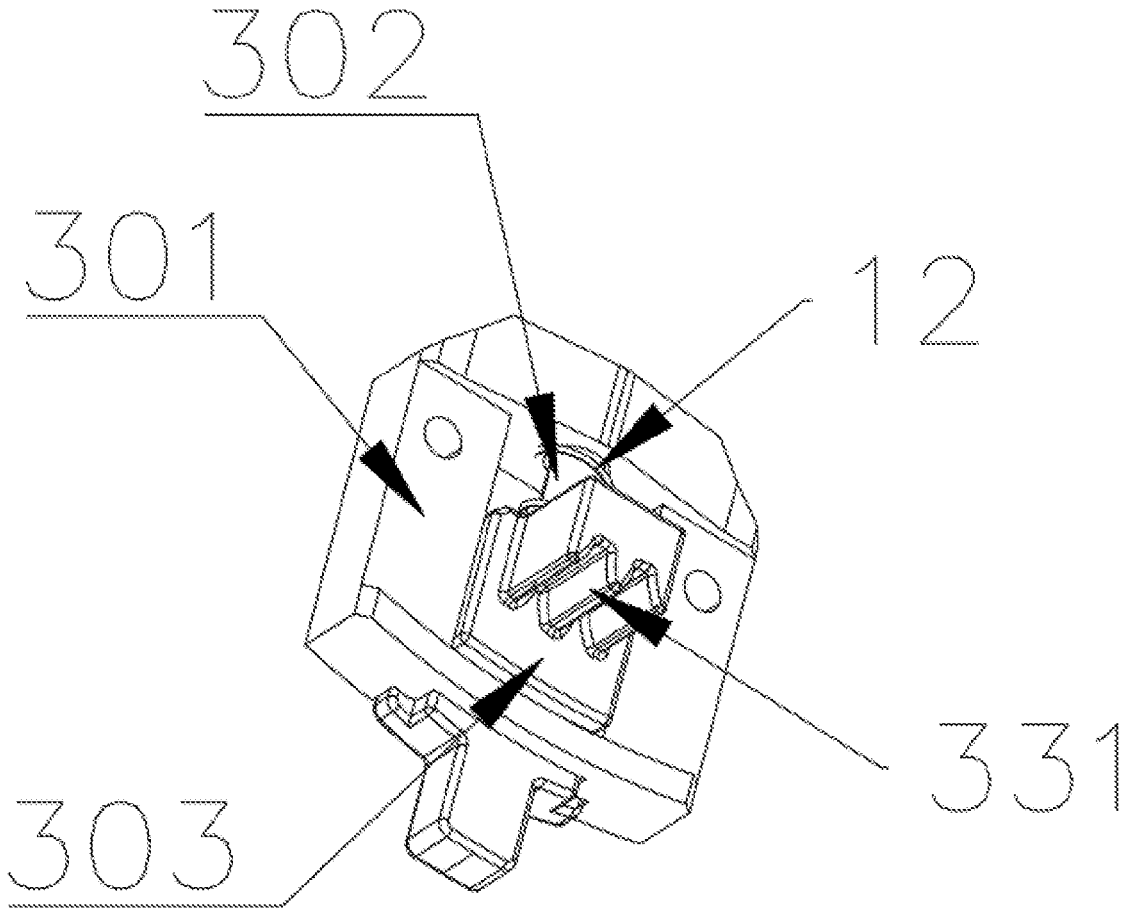
FIG. 9 is a structural schematic diagram of a limiting assembly.
Figure 10:
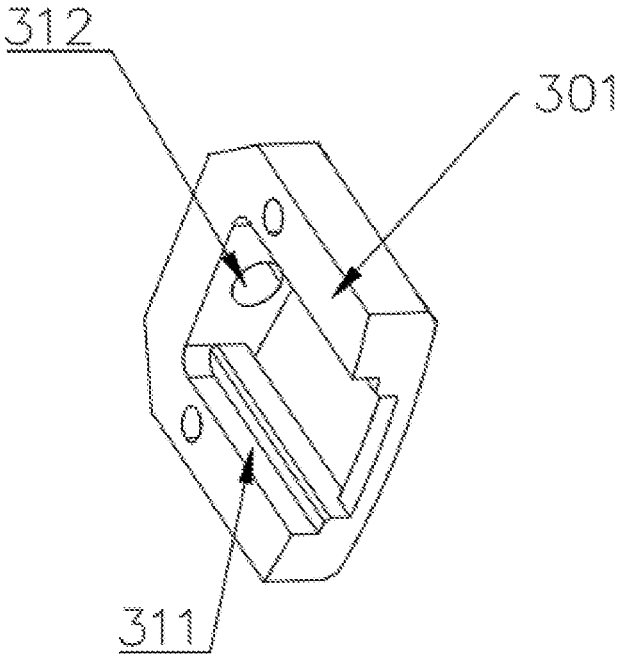
FIG. 10 is a structural schematic diagram of a U-shaped fixed block.
Figure 11:
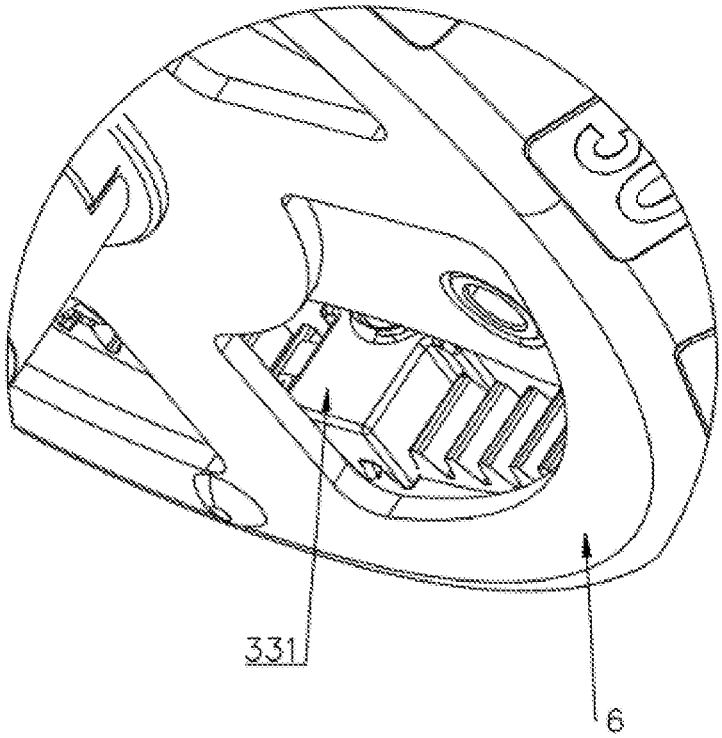
FIG. 11 is a state schematic diagram of the limiting assembly clamping the inner fluted disc.
Figure 12:
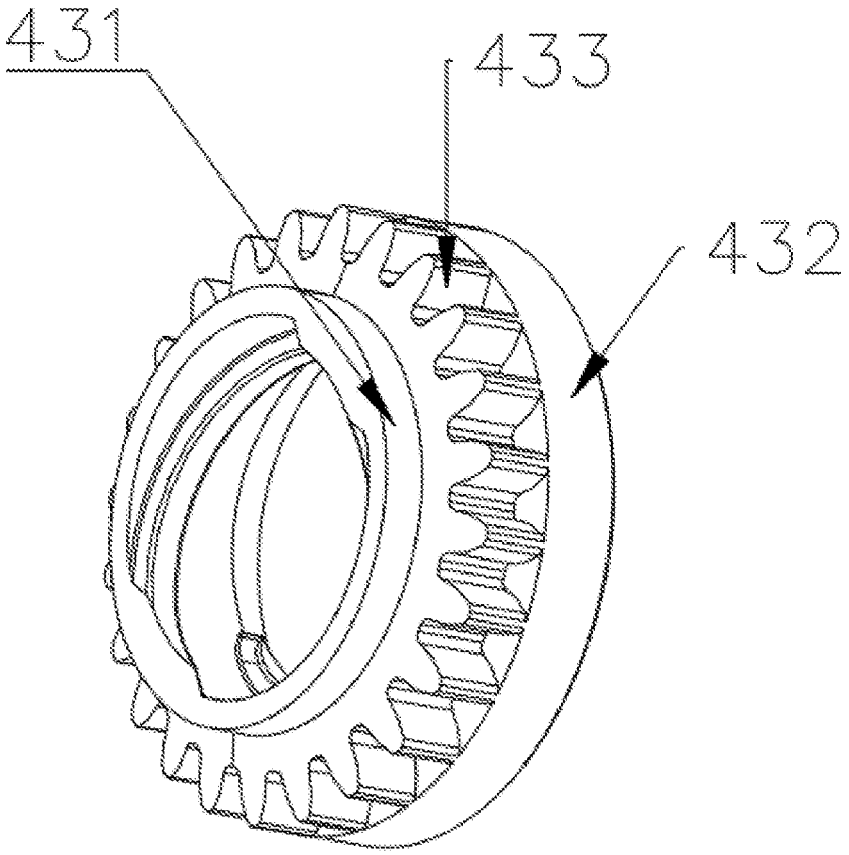
FIG. 12 is a structural schematic diagram of the internal helical gear according to an example.
Figure 13:
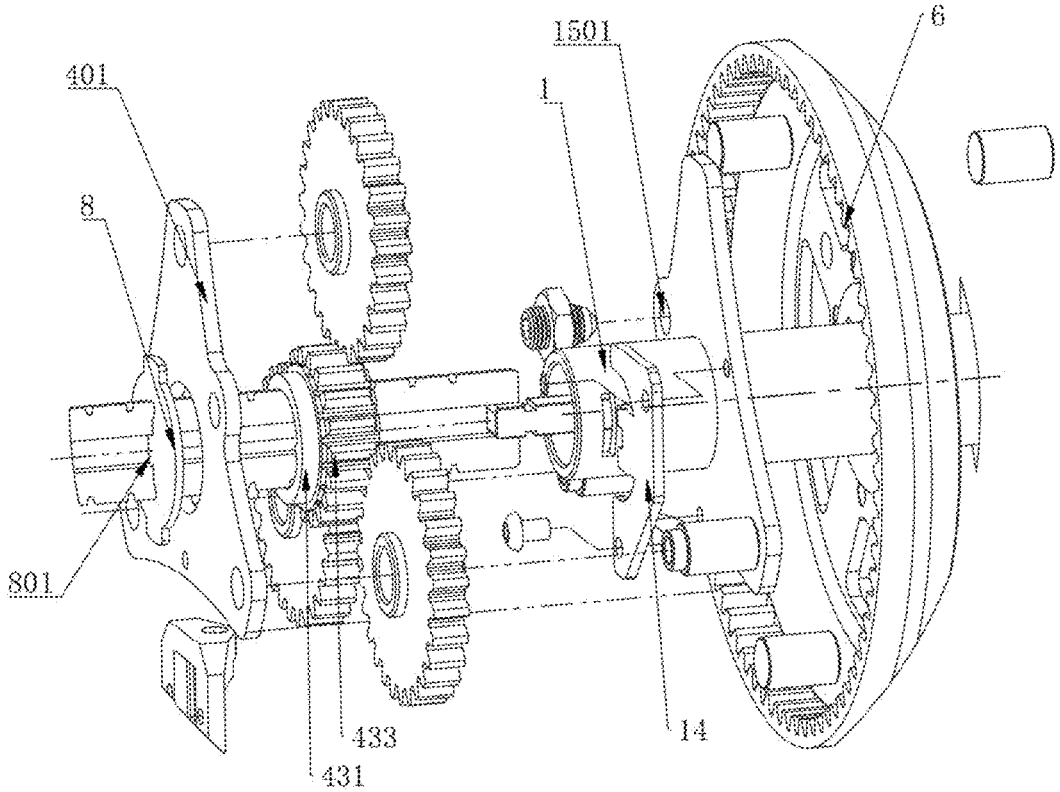
FIG. 13 is a structural explosive view of an example 2 of the present application.

Referring to FIGS. 1-13, the present application provides the following technical solution: an adjustable dumbbell includes a dumbbell bar 100, linear adjusting mechanisms and counterweight mechanisms 200 are disposed at both ends of the dumbbell bar 100, said dumbbell bar 100 includes a sleeve 1, and two telescopic mandrels 2 disposed in the sleeve and in sliding fit with each other. The counterweight mechanisms 200 are coaxially disposed at both ends of the dumbbell bar 100, and configured to provide the overall weight of the adjustable dumbbell. Said linear adjusting mechanism includes a limiting assembly 3 and a gear adjusting assembly 4. The gear adjusting assembly 4 is configured to allow the two telescopic mandrels 2 to be close to or away from each other, so as to control the overall combination length of the two telescopic mandrels 2. The limiting assembly 3 is configured to secure the relative positions of two telescopic mandrels 2.

In the implementation, the length of the dumbbell bar 100 is adjusted by the gear adjusting assembly 4, and then secured by the limiting assembly 3 after adjustment to achieve the length adjustment of the dumbbell bar 100, and after the length adjustment is completed, the counterweight mechanisms 200 at the two ends of the dumbbell bar 100 are adjusted to complete the adjustment of counterweights.

As an example of the present application, a connector 5 is disposed between said telescopic mandrels 2, and configured to connect the two telescopic mandrels 2. One sides of said two telescopic mandrels 2 are respectively provided with a linear groove 201, and said two linear grooves 201 define a mounting space of the connector 5, and the outside of said telescopic mandrel 2 is provided with an external thread extending along the axial direction of the telescopic mandrel.

In the implementation, said two telescopic mandrels 2 are coaxially close to or away from each other to achieve the increase and decrease of the overall combination length of the telescopic mandrels 2, and the connection key 5 plays a connecting role on the one hand while playing a guide role on the other hand.

As an example of the present application, the end portions of said two telescopic mandrels 2 are respectively sleeved with a circular guide plate 8, and a guide bulge 801 corresponding to the linear groove 201 is disposed on said guide plate 8 to prevent the telescopic mandrel 2 from rotating and achieve a guide effect simultaneously.

Said gear adjusting assembly 4 includes an inner fluted disc 6 and a planetary gear structure. Said planetary gear structure includes two planetary gear carriers 401, a planetary gear 402 and an internal helical gear 403, and the planetary gear 402 and the internal helical gear 403 are disposed between the two planetary gear carriers 401. Said internal helical gear 403 is sleeved on the outside of the telescopic mandrels 2 and disposed in the centers of the planetary gear carriers 401, and the internal helical gear 403 is in threaded connection with the telescopic mandrel 2 and drives the telescopic mandrel 2 to carry out a linear reciprocating motion. Said planetary gear 402 is disposed on the planetary gear carriers, the inner side of the planetary gear 402 is meshed with the internal helical gear 403, and the outer side of the planetary gear 402 is meshed with the inner fluted disc 6.

A locking assembly 7 is disposed between said internal helical gear 403 and the planetary gear carrier 401 towards the telescopic mandrel 2, said locking assembly includes a locking clamp plate 701 and a clamp plate mounting sleeve 702, said clamp plate mounting sleeve 702 is sleeved on the sleeve 1, and in threaded connection with the end portion of said sleeve 1. One side of said clamp plate mounting sleeve 702 is provided with a clamp plate mounting groove, and the other side of said clamp plate mounting sleeve 702 is connected to the internal helical gear 403 in a sleeve-connected mode. One end of said locking clamp plate 701 is disposed in the clamp plate mounting groove, and the other end of said locking clamp plate 701 passes through the sleeve 1 to clamp the connector 5.

In the implementation, the internal helical gear 403 include a T-type sleeve, said T-type sleeve includes a sleeve body 431 and a sleeve body cover 432, an outer ring of said sleeve body 431 is nested in the internal helical gear body 433, the internal helical gear body 433 is meshed with the planetary gear 402, the inner side of said sleeve body 431 is in threaded connection with the telescopic mandrel 2, so as to planetarily define a screw-nut structure, the rotation of the sleeve body 431 drives the telescopic mandrel 2 to carry out a linear motion, and the sleeve body cover 432 is connected to the internal helical gear 403 in a sleeve-connected mode.

In the implementation, the locking clamp plates 701 at the two ends pass through the sleeve 1 to both clamp the connector 5, so that the axial motions of the sleeve 1 and the connector 5 are limited, moreover, an effect of limiting the rotation of the telescopic mandrels 2 is also achieved, and a guide effect is achieved during the relative motion of the telescopic mandrels 2, at the same time, the locking clamp plate 701, because the mating surfaces of the two telescopic mandrels 2 are reduced after the telescopic mandrels 2 are away from each other, is provided with the connector 5 to ensure the stability of the dumbbell bar, and finally realize the securement of the overall combination length of the dumbbell bar. As an example, the clamp plate mounting sleeve 702 reduces an axial clearance.

Said internal helical gear 403 is provided with an internal thread meshed with an external thread of the telescopic mandrel 2, said telescopic mandrel 2 and the internal helical gear 403 define a screw-nut structure, and the rotation of the internal helical gear 403 drives the telescopic mandrel 2 to carry out a linear motion through a thread structure.

As an example of the present application, the outside of said sleeve 1 is also sleeved with a driving cylinder 9, and said inner fluted disc 6 is connected to the driving cylinder 9 in a clamped mode. The center of the inner fluted disc 6 is provided with a plurality of bulges 601, and the two ends of the driving cylinder 9 are provided with clamp slots 901 corresponding to the bulges 601, and the driving cylinder 9 rotates to drive the rotation of the inner fluted disc 6.

In the implementation, the driving cylinder 9 rotates to drive the inner fluted disc 6, the inner fluted disc 6 is meshed with the planetary gear 402, the planetary gear 402 is meshed with the internal helical gear 403 to drive the internal helical gear 403 to rotate, and the internal helical gear 403 and the telescopic mandrel 2 define a screw-nut structure, the internal helical gear 403 rotates to drive the telescopic mandrel 2 to carry out a reciprocating linear motion, so as to achieve an effect that the two telescopic mandrels 2 are close to and away from each other, thereby completing the length adjustment of the dumbbell bar 100.

As an example of the present application, a variable-speed gear 404 is disposed between the planetary gear 402 and the planetary gear carrier 401, the planetary gear 402 and the variable-speed gear 404 are coaxially disposed on the planetary gear carrier 401, the variable-speed gear 404 is connected to the inner fluted disc 6, and the inner fluted disc 6 when rotating drives the variable-speed gear 404 to rotate, and then further drives the planetary gear 402 to rotate, thereby achieving different transmission ratios.

As an example of the present application, a ball set screw 15 is disposed on said planetary gear carrier 401, and a prelocating groove 1501 corresponding to the ball set screw 15 is disposed on said inner fluted disc 6. When the ball set screw 15 is located in the prelocating groove 1501, the two telescopic mandrels 2 is in the initial positions thereof.

As an example of the present application, two limited posts 16 are also arranged on one side of said inner fluted disc 6, and disposed on the planetary gear carrier 401 on the inner side, a limit plate 1601 is disposed on the planetary gear carrier 401 to limit the maximum rotating angle of the inner fluted disc 6, and the relative maximum distance of movement of the telescopic mandrels 2 is limited via the two limited posts 16 and the limit plate 1601.

As an example of the present application, said limiting assembly 3 includes a U-shaped fixed block 301 and a locking pin 302, one end of the locking pin 302 is a locking pin fixed block 303, and the other end of the locking pin 302 passes through the U-shaped fixed block 301 to limit the gear adjusting assembly 4 that is adjusted. A reset spring 12 is disposed between said locking pin fixed block 303 and the U-shaped fixed block 301, and configured to reset the locking pin 302.

In the implementation, a sliding chute 311 and a through hole 312 are provided in the U-shaped fixed block 301, a locking pin 302 mounting hole is provided in the locking pin fixed block 303, one end of the locking pin 302 is secured in the locking pin 302 mounting hole, and the other end of the locking pin 302 may pass through the through hole 312 to clamp the gear adjusting assembly 4.

In the implementation, a limit ratchet 331 is disposed on one side of the locking pin fixed block 303, when adjustment is completed, under the action of the reset spring 12, the locking pin fixed block 303 is pushed out of the sliding chute 311 of the U-shaped fixed block 301, at this point, the limit ratchet 331 clamps the teeth of the inner fluted disc 6 to achieve the limitation to the inner fluted disc 6, and then, the limitation to the gear adjusting assembly 4 is further completed to prevent the gear adjusting assembly 4 from continuing to rotate, thereby achieving a dead lock effect.

Said limit ratchet 331 is W-shaped, and defines two limit bulges and two limit grooves, the limit ratchet 331 is tightly clamped on the teeth of the inner fluted disc 6 under the action of the reset spring 12, so as to achieve the dead lock effect and prevent the gear adjusting assembly 4 from rotating, thereby ensuring the stability of the dumbbell in use.

Said counterweight mechanism 200 includes a plurality of counterweight substrates 10, the upper and lower ends of said counterweight substrate 10 are respectively provided with a mounting groove, the counterweight substrates 10 are connected through a buckling assembly, and the buckling assembly is detachably connected to said mounting grooves.

As an example of the present application, the adjustable dumbbell also includes a dumbbell holder 11 configured to secure said adjustable dumbbell.

Working Principle:

When it is required to carry out adjustment, the limit ratchet 331 is detached from the teeth of the inner fluted disc 6 while the locking pin fixed block 303 is pushed forward, at this point, the driving cylinder 9 is rotated, the driving cylinder 9 drives the inner fluted disc 6 to rotate, the inner fluted disc 6 drives the planetary gear 402 to rotate, the planetary gear 402 drives the internal helical gear 403 to rotate, and further drives the telescopic mandrels 2 to carry out a linear motion, when a required length is achieved, the number of the counterweight substrates of the counterweight mechanism 200 is adjusted. A locating bulge on the locking clamp plate 701 is clamped on the connector 5, in the meantime, under the action of the reset spring 12, the locking pin fixed block 303 is pushed out of the sliding chute 311 of the U-shaped fixed block 301, at this point, the limit ratchet 331 clamps the teeth of the inner fluted disc 6 to achieve the limitation to the inner fluted disc 6, and then the limitation to the gear adjusting assembly 4 is further completed to prevent the gear adjusting assembly 4 from continuing to rotate.

Example 2

Figure 14:
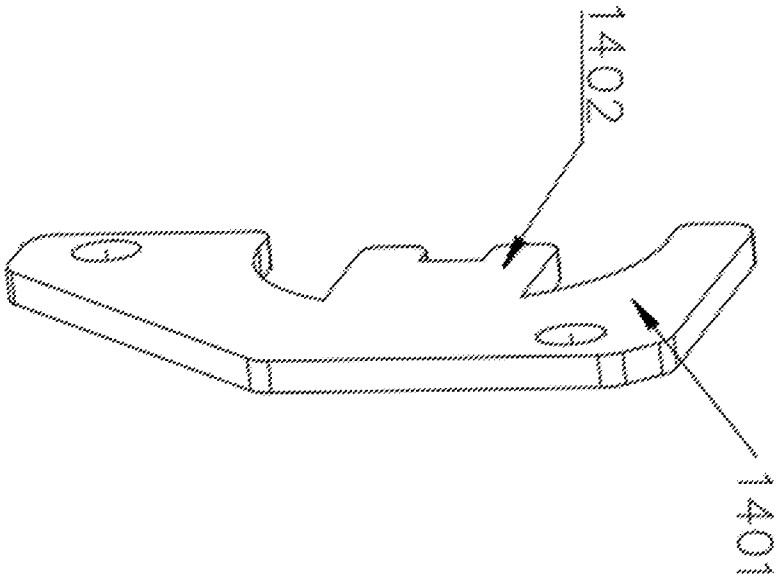
FIG. 14 is a structural schematic diagram of a locking member according to the example 2.

As shown in FIGS. 1-14, as an example of the present application, a locking assembly consisting of a locking clamp plate 701 and a clamp plate mounting sleeve 702 may be replaced by a locking member 14, meanwhile, an internal helical gear 403 only consists of a sleeve body 431, an inner ring of the sleeve body 431 is in threaded connection with the telescopic mandrel 2 to define a screw-nut structure, and an outer ring of the sleeve body 431 is defined by the meshing of the internal helical gear body 433 and the planetary gear 402. Said locking member 14 includes a locking member body 1401 and a locking member bulge 1402, said locking member grooves are correspondingly disposed on the locking member bulge 1402 and the connector 5, and the locking member bulge 1402 passes through the sleeve 1 to clamp the connector 5. The two ends of said locking member body 1401 are fixedly connected to the planetary gear carrier 402 by bolts.

In the description of the present application, it should be understood that the orientation or position relationships indicated by the terms "center". "longitudinal". "transverse". "length", "width". "thickness". "up". "down". "before", "after". "left", "right", "vertical". "horizontal", "top". "bottom" "within" and "outside" and the like are orientation or position relationships shown based on the accompanying drawings, only intended to facilitate the description of the present application and simplify the description, instead of indicating or implying that mentioned devices or elements must have particular orientations, and be constructed and operated in a particular orientation, therefore, the orientation or position relationships will not be construed as a limitation to the present application.

Furthermore, the terms "first" and "second" are intended for purposes of illustration only, and are not to be understood as indicating or implying relative importance or implicitly indicating the number of indicated technical features. Thus, features defined with "first" or "second" may explicitly or implicitly include one or more of these features. In the description of the present application. "a plurality of" means at least two, e.g., two, three, etc., unless specifically specified otherwise.

In the present application, unless otherwise expressly specified and defined, the terms "installation", "connected", "connection", "securement", etc., shall be understood broadly. e.g., the term "connection" may be understood as fixed connection, detachable connection, or integration; may be understood as mechanical connection, electrical connection or mutual communication; also may be understood as direct connection, indirect connection implemented via an intermediate medium, communication between insides of two elements or interaction between two elements. For persons of ordinary skill in the art, the specific meaning of the above terms in the present application may be understood on a case-by-case basis.

Although preferred examples of the present application have been described, additional changes and amendments may be made to these examples by those skilled in the art once basic creative concepts are known. Therefore, the attached claims are intended to be construed to include the preferred examples and all changes and amendments falling within the scope of the present application.

Obviously, those skilled in the art may make various changes and variations to the present application without departing from the spirit and scope of the present application. Thus, if such amendments and variations of the present application fall within the scopes of the claims of the present application and equivalent technologies thereof, the present application is also intended to include such changes and variations.

What is claimed is:

1. An adjustable dumbbell, comprising: a dumbbell bar, linear adjusting mechanisms and counterweight mechanisms, wherein the linear adjusting mechanisms and the counterweight mechanisms are disposed at both ends of the dumbbell bar, said dumbbell bar includes a sleeve and two telescopic mandrels disposed in the sleeve and in sliding fit with each other;

said counterweight mechanisms are coaxially disposed at the both ends of the dumbbell bar, and configured to provide an overall weight of the adjustable dumbbell; and each of said linear adjusting mechanisms comprises a limiting assembly and a gear adjusting assembly, wherein the gear adjusting assembly is configured to allow the two telescopic mandrels to be close to or away from each other, so as to control an overall combination length of the two telescopic mandrels; and the limiting assembly is configured to limit the gear adjusting assembly, said limiting assembly comprises a U-shaped fixed block and a locking pin, a sliding chute and a through hole are provided in the U-shaped fixed block, one end of the locking pin is a locking pin fixed block, and the other end of the locking pin passes through the through hole of the U-shaped fixed block to limit the gear adjusting assembly that is adjusted; and a reset spring is disposed between said locking pin fixed block and the U-shaped fixed block, and is configured to reset the locking pin, the gear adjusting assembly comprises an inner fluted disc, a limit ratchet is disposed on one side of the locking pin fixed block, when the locking pin fixed block is pushed out of the sliding chute of the U-shaped fixed block under an action of the reset spring, the limit ratchet clamps teeth of the inner fluted disc, and the gear adjusting assembly is limited from rotating.

2. The adjustable dumbbell according to claim 1, wherein a connector is disposed between said telescopic mandrels, and is configured to connect the two telescopic mandrels; one side of each of said two telescopic mandrels is provided with a linear groove, said two linear grooves of the telescopic mandrels define a mounting space of the connector, and an outside of each of said telescopic mandrels is provided with an external thread extending along an axial direction of the telescopic mandrel.

3. The adjustable dumbbell according to claim 2, wherein said gear adjusting assembly further comprises a planetary gear structure; said planetary gear structure comprises two planetary gear carriers, a planetary gear and an internal helical gear, and the planetary gear and the internal helical gear are disposed between the two planetary gear carriers; wherein said internal helical gear is sleeved on the outside of the telescopic mandrel and disposed in centers of the planetary gear carriers, and the internal helical gear is in threaded connection with the telescopic mandrel and drives the telescopic mandrel to carry out a linear reciprocating motion; and said planetary gear is disposed on the planetary gear carriers, an inner side of the planetary gear is meshed with the internal helical gear, and an outer side of the planetary gear is meshed with the inner fluted disc.

4. The adjustable dumbbell according to claim 3, wherein a locking assembly is disposed between said internal helical gear and one of said planetary gear carriers towards the telescopic mandrel, said locking assembly comprises a locking clamp plate and a clamp plate mounting sleeve, said clamp plate mounting sleeve is sleeved on the sleeve, and is in threaded connection with an end portion of said sleeve; one side of said clamp plate mounting sleeve is provided with a clamp plate mounting groove, and the other side of said clamp plate mounting sleeve is connected to the internal helical gear in a sleeve-connected mode; and one end of said locking clamp plate is disposed in the clamp plate mounting groove, and the other end of said locking clamp plate passes through the sleeve to clamp the connector.

5. The adjustable dumbbell according to claim 3, wherein an outside of said sleeve is further sleeved with a driving cylinder, and said inner fluted disc is connected to the driving cylinder in a clamped mode, wherein a center of the inner fluted disc is provided with a plurality of bulges, two ends of the driving cylinder are provided with clamp slots corresponding to the bulges, and the driving cylinder rotates to drive a rotation of the inner fluted disc.

6. The adjustable dumbbell according to claim 2, wherein an end portion of each of said two telescopic mandrels is sleeved with a circular guide plate, and a guide bulge corresponding to the linear groove is disposed on said guide plate.

7. The adjustable dumbbell according to claim 1, further comprising a dumbbell holder configured to secure said adjustable dumbbell.

* * * * *